United States Patent [19]

Williams

[11] 4,159,415

[45] Jun. 26, 1979

[54] ELECTRIC SLOT FURNACE

[75] Inventor: John R. Williams, Arlington Heights, Ill.

[73] Assignee: Klein Tools, Inc., Chicago, Ill.

[21] Appl. No.: 856,922

[22] Filed: Dec. 5, 1977

Related U.S. Application Data

[63] Continuation-in-part of Ser. No. 760,846, Jan. 21, 1977, abandoned.

[51] Int. Cl.[2] ..... F27B 5/14; F27D 11/02

[52] U.S. Cl. ..... 219/390; 13/22; 219/408; 219/409; 219/494; 219/553; 252/516; 338/317

[58] Field of Search ..... 13/20, 22, 25, 31; 219/385, 390, 408, 409, 411, 412, 413, 494, 505, 510, 552, 553; 378/317, 332; 252/516; 428/446, 596

[56] References Cited

U.S. PATENT DOCUMENTS

| | | | |
|---|---|---|---|
| 2,543,708 | 2/1952 | Rice et al. | 13/31 |
| 2,749,424 | 6/1956 | Dieterich | 219/552 |
| 2,836,696 | 5/1958 | Rutchford | 219/390 |
| 2,891,303 | 6/1959 | Stevenson | 428/596 |
| 2,896,004 | 7/1959 | Duffy et al. | 13/22 |
| 2,907,972 | 10/1959 | Schildhauer et al. | 338/332 |
| 2,913,695 | 11/1959 | Borghult et al. | 338/317 |
| 2,916,535 | 12/1959 | Marden et al. | 13/22 |
| 3,009,886 | 11/1961 | Wejnarth | 252/516 |
| 3,404,031 | 10/1968 | Clayton et al. | 428/446 |
| 3,518,351 | 6/1970 | Ohnsorg et al. | 13/25 |
| 3,541,293 | 11/1970 | MacDonald et al. | 219/390 |
| 3,626,154 | 12/1971 | Reed | 219/411 |
| 3,726,984 | 4/1973 | Anthony et al. | 13/25 |
| 3,805,024 | 4/1974 | Joeckel et al. | 219/553 |
| 3,859,500 | 1/1975 | Mutys | 219/553 |
| 3,866,017 | 2/1975 | Keren et al. | 219/390 |

*Primary Examiner*—R. N. Envall, Jr.
*Attorney, Agent, or Firm*—Fitch, Even & Tabin

[57] ABSTRACT

A slot furnace for heating steel to forging temperatures includes a housing lined with refractory material and a refractory hearth all defining a chamber in the housing for receiving and heating forging stock. A slot is located at the front of the housing adjacent the hearth in communication with the chamber through which forging stock is inserted and withdrawn. Electrical heating elements are provided at either side of the chamber inwardly of the side walls of the chamber. The ceiling that defines the top of the chamber protrudes inwardly between the elements and above the slot. Means are provided for connecting the heating elements to an electrical power source. A temperature sensor is provided in the chamber adjacent the hearth and means connected to the sensor are provided for controlling the electrical power applied to the elements in response to the sensor.

39 Claims, 10 Drawing Figures

ELECTRIC SLOT FURNACE

This is a continuation-in-part of application Ser. No. 760,846, filed Jan. 21, 1977, now abandoned.

The invention relates to furnaces for heating steel to forging temperatures and particularly to electric heating element batch furnaces for same.

It is a familiar experience that batch-type furnaces are used for heating steel to forging temperatures and are usually loaded and unloaded by hand, the heating time being determined by the furnace operator. Typically, batch furnaces used for heating forging stock are of the slot type, and instead of a door, these furnaces have a horizontal opening across the front through which the forging stock is received into the heating chamber. These furnaces generally have a refractory hearth and fire brick inner side walls and an inner arched roof and may be oil-fired or gas-fired with burner units extending into the heating chamber through the side walls of the furnace. Because combustion occurs within the chamber, a flue is provided and there may be a gas curtain to minimize entry of oxygen into the chamber.

During combustion of gas-fired and oil-fired furnaces, oxidizing agents are either present or formed as a result of the combustion of the fuel. Furthermore, other products are formed that contaminate the air and may require the use of costly pollution control devices to meet clean air standards. Oxidizing agents, such as carbon dioxide and water vapor, cause decarborization and scaling of the forging steel. Carbon monoxide also may be present and is a carborizing agent. There exists a delicate balance in the ratio of fuel to air that will burn to produce an atmosphere substantially neutral to steel, i.e., that is neither carborizing or decarborizing. Excessive air reduces heating efficiency and allows excessive scale formation on the forging stock. Insufficient air also reduces heating efficiency, but results in a thin scale on the steel that is difficult to remove. Moreover, in the instance of oil-fired burners, an improper mixing of oil and air may result not only in poor combustion, but in soot deposits on the furnace hearth and walls. Where the forging operation includes a die impression in which the stock is forged close to final dimensions and decarborization cannot be tolerated, a controlled atmosphere, such as a full muffle type furnace, may be used to protect the forging stock.

Because of the special emphasis currently on conserving energy, especially gas and oil, it has been proposed to convert existing gas and oil-fired batch furnaces to electrical heat because of the reasonable forecast that through nuclear power electricity is expected to become more available than gas or oil in the future. As gas and oil become scarce, their prices are expected to escalate at a more rapid rate than electricity.

It has been found, however, that merely converting existing furnaces to electrical heating is not a solution to the problem. The construction of existing furnaces are not such that forging stock can be heated to forging temperatures rapidly and uniformly throughout the heating zone of a slot furnace with the kinds of efficiencies needed to effectively utilize electricity as a power source vis-a-vis gas and oil. As a means of effecting electrical conversion, however, it has also been proposed to close flue openings in the furnace and other kinds of circulation openings typically used in muffles to eliminate some of the heat losses and to improve efficiencies as a result. Such steps, however, likewise have not proved to be a desirable solution to the problem.

While various forms of electrically heated furnaces are known for heating steel to forging temperatures, it is an object of this invention to provide an improved batch-type furnace in the form of a slot furnace heated by energy other than gas or oil for heating steel to forging temperatures and be at least as economical to operate as gas or oil-fired furnaces.

It is a further object of this invention to provide a slot furnace of the foregoing type that has substantially no need for air purification devices.

It is yet another object of this invention to provide a slot furnace of the foregoing type that is efficient, safe, and has a rapid response to production demands.

It is yet another object of this invention to provide a slot furnace of the foregoing type having a firing chamber that has a minimum circulation of air to reduce scaling of the forging steel.

These and other objects and advantages of the invention will become apparent and the invention better understood by reference to the following detailed description read in conjunction with the accompanying drawings, in which.

Briefly, a slot type batch furnace for heating steel to forging temperatures in accordance with the invention is one which avoids the use of gas or oil for heating and avoids the need for a muffle to control or substantially eliminate scale forming on the forging stock. Rather, it employs electrical heating elements within a newly configured heating chamber to heat steel placed on its hearth uniformly to forging temperatures, and such operation compares favorably economically with present furnaces using gas or oil as the heating source. The effect is to not only provide for an alternative source of heat when energy is critical, but also for a more simple furnace construction while enhancing the quality of the surface of the heating forging stock.

Figure 1:
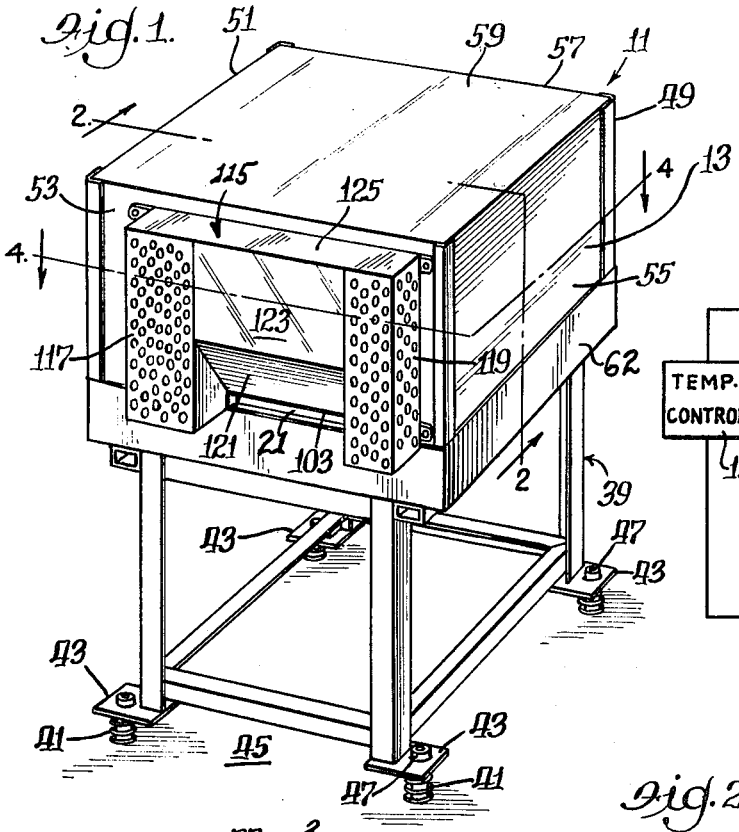
FIG. 1 is a perspective view of a slot furnace constructed in accordance with the principles of this invention.
Figure 2:
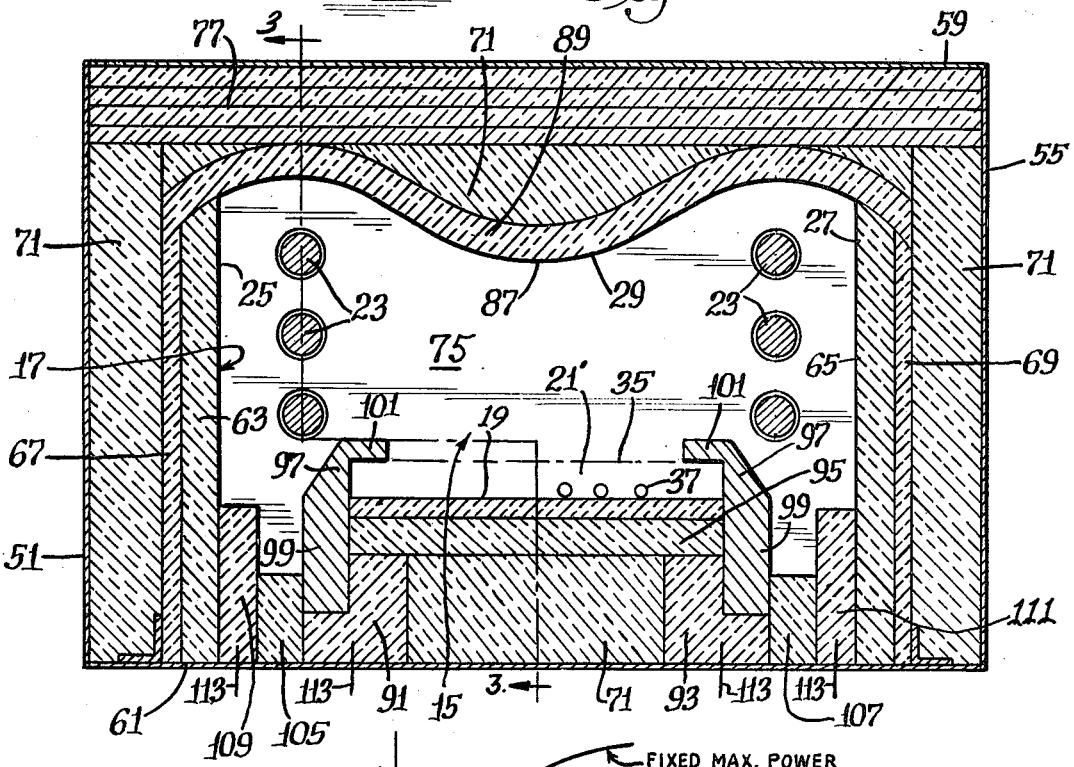
FIG. 2 is a sectional view taken along the line 2—2 of FIG. 1.

Referring now to FIGS. 1 and 2 for a brief description of the illustrated construction, a slot furnace 11 is provided with a metal outer shell housing 13, a heating chamber 15, and a heat insulating lining 17. A hearth 19 is provided in the chamber 15 and serves as a floor on which bars or rods 37 of forging stock are placed for heating. A slot 21 extends horizontally in an elongated manner at the front of the housing 13 adjacent the hearth and is in communication through the lining 17 with the chamber 15. The forging stock is inserted and withdrawn through the slot 21.

An electrical heating element 23 is disposed at each side of the chamber 15 on the inside of and next to inner side walls 25 and 27 respectively of the lining. In the illustrated embodiment, three such electrical heating elements 23 are provided at each side of the chamber. These elements extend parallel with the side walls 25 and 27 and are at right angles to the plane of the slot 21, i.e., the elements extend generally parallel to the direction of forging stock insertion. The arrangement and location of these elements are described in further detail in the following paragraphs.

Figure 5:
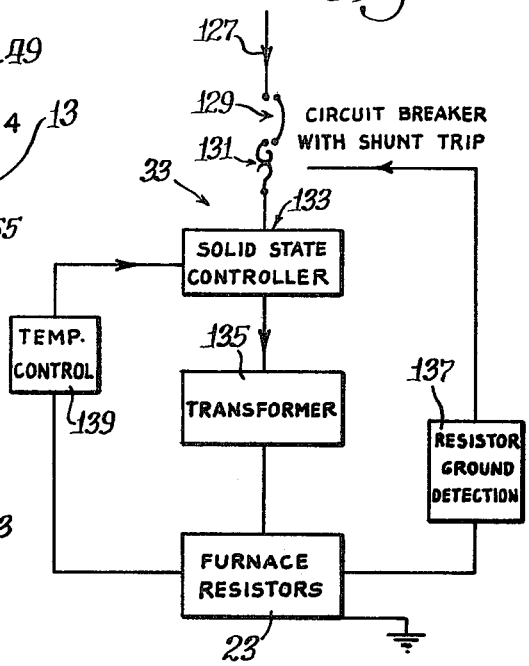
FIG. 5 is a schematic diagram of the power and control circuit used in the furnace of FIG. 1.

A ceiling 29 defines the top of the chamber 15, and protrudes into the chamber from the side walls 25 and 27 respectively to a low portion or line 87 paralleling the electrical heating elements 23 and disposed between these heating elements and in particular centered with respect to the slot 21 as described in detail hereinafter. The extent of the protrusion of the ceiling 29 into the chamber 15 (the line 87) is above the slot 21. Thus, the ceiling does not extend into a volume 35 bounded by lines projecting the slot 21 to a projection 21' thereof on the back inner wall. A temperature sensor 31 (FIGS. 3 and 4) is provided adjacent the hearth to detect the temperature of the hearth. In FIG. 5, there is shown a schematic diagram illustrating schematically a power circuit with control, generally referred to as 33, for operating the furnace 11. The temperature sensor 31 is connected into this circuit as will be described in detail hereinafter.

The volume 35 defined by the projection lines of the slot 21 to 21' illustrates the relationship between the opening of the slot, the chamber 15 generally and various other members to be described hereinafter. The forging stock, such as the steel rods 37, is inserted to a position on the hearth 19 within the boundaries of the volume 35. Heat from the elements 23 is reflected from the side walls 25 and 27 and the ceiling 29 to the hearth 19 to heat the rods 37. The slot 21 is the only opening into the chamber 15, and little air from the outside of the furnace enters the chamber to circulate therein. Accordingly, little convection occurs, and most of the heat is transmitted through radiation. As will be seen hereinafter, the fire walls bounding the chamber 15 radiate heat efficiently with little absorption of the heat.

When the bars or rods 37 are first placed on the hearth 19, they are cold relative to the hearth and immediately draw heat from it, reducing the hearth temperature, which is immediately detected by the sensor 31. Heat is called for by the sensor and power is applied to the elements 23 in response until the sensor is satisfied. At such time the power is removed from the elements 23 or at least modulated to maintain the temperature at a given predetermined level.

Because little additional oxygen is added to the mixture within the chamber, relatively little scaling occurs on the rods 37. Several advantages accrue to the bars or rods having less scale, such as a finer surface finish, a greater forging die life, and use of smaller forging stock because the bars or rods are sized closer to that required for the finished product.

More specifically, because a furnace, such as the slot furnace 11, is located close to a forging hammer it is subject to the impact of the hammer. To diminish the effect of this impact, the illustrated embodiment of the furnace 11 is mounted on an angle and channel iron support table 39, which in turn has a provision for shock absorbing mountings to the floor, such as by a plurality of coil springs 41 suitably interceding between pads 43 and the floor 45 to provide cushioned mountings at anchor bolts 47. The height of the table 39 is selected to place the slot 21 at a level convenient for the operator to insert and withdraw the rods 37.

Figure 3:
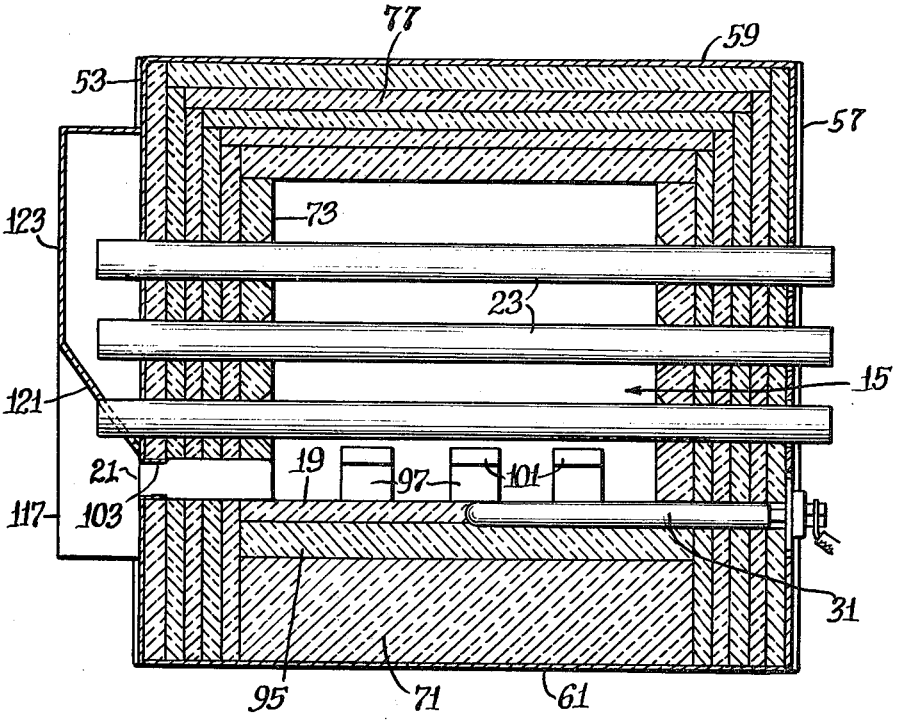
FIG. 3 is a side sectional view taken along the line 3—3 of FIG. 2.
Figure 4:
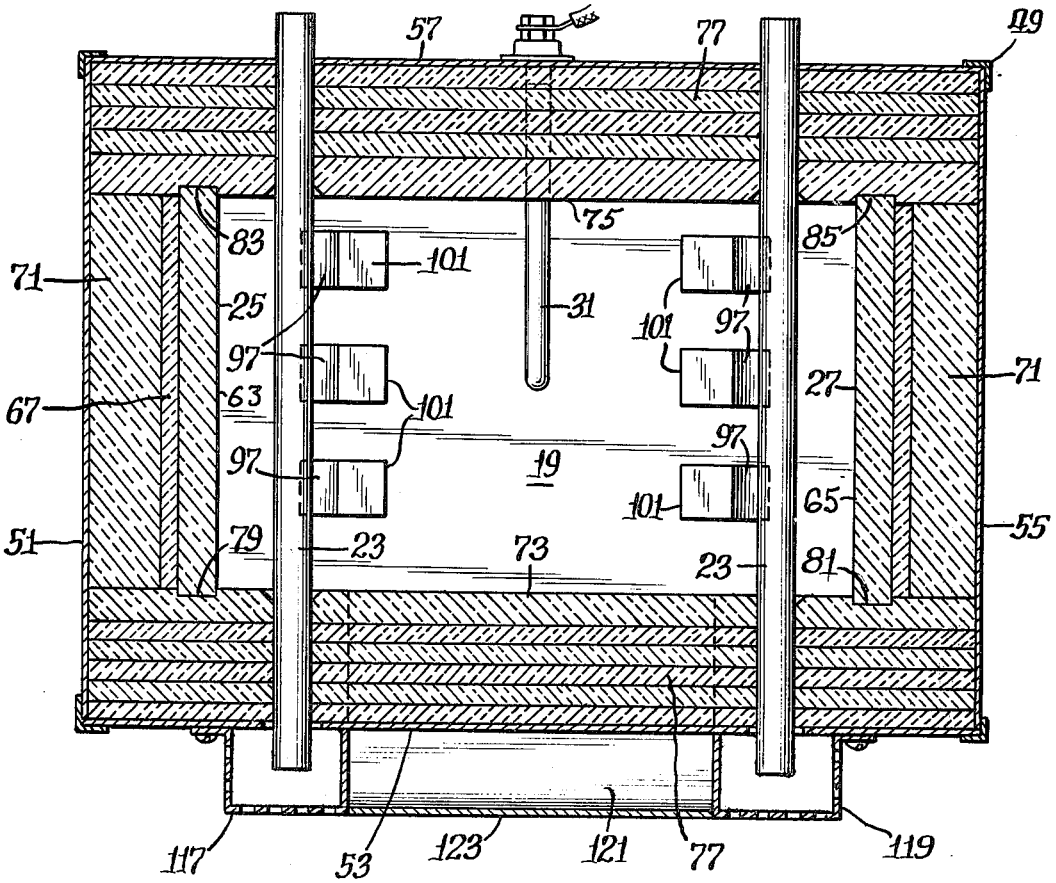
FIG. 4 is a plan sectional view taken along the line 4—4 of FIG. 1.

The details of construction of the furnace 11 are best seen in FIGS. 2, 3 and 4. Referring first to FIG. 2, the heating chamber 15 is defined by the heat insulating lining 17. Such heat insulation is refractory material capable of withstanding operating temperatures up to about 3000° F.

As used herein, the term "refractory" is intended to refer to material which will resist change of shape, weight, or physical properties at high temperatures.

The outer shell housing 13 constitutes the basic structural support for the furnace 11. As seen in FIG. 1, the outer shell 13 includes corner angles 49, wall plates 51, 53, 55 and 57, top plate 59, and base plate 61 (FIG. 2). A ring of outer foundation plates, exemplified by a plate 62 (FIG. 1), is also provided. This outer shell 13 is of a suitable metal and serves as a structural support for the furnace as well as a means of grounding the structure (FIG. 5).

Inside the metallic shell housing 13 is the heat insulating lining 17 which includes several layers of material. Preferably, this material is of an asbestos-free, high temperature ceramic fiber insulation. One source of supply of such material is Carborundum Co., Niagara Falls, N.Y. Such high temperature insulation produced by this company is made from high-alumina ceramic fiber and inorganic bonds. Such ceramic fiber insulation is available in a flexible blanket form, in flat or curved boards, and as loose fill. Furthermore, vacuum-formed special shapes can be made to order. One source of supply for the fire wall material, i.e., the material forming all inner surfaces of the heating chamber 15 except the hearth, is Refractory Products, Inc. of Carpentersville, Ill. This company's material is known as WRP-XA and is usable to 3000° F. The following illustrates its typical physical properties:

| | |
|---|---|
| Average Density: | 15#/cu.ft. |
| Approximate Chemical Analysis: | |
| $Na_2O$ (Total sodium) | .06% |
| $Na_2O$ (Leachable sodium) | .005% |
| $Fe_2O_3$ | .001% |
| $B_2O_3$ | .005% |
| All other Trace Inorganics (Includes CaO, MgO, NiO, CrO) | .15% |
| $Al_2O_3$, $SiO_2$ | Balance |
| Permanent Linear Change After Firing for 24 Hours At: | Permasized for Minimum Shrinkage |
| 2000° F. | .6% |
| 2200° F. | .8% |
| 2300° F. | 1.25% |
| 2400° F. | 1.75% |
| 2500° F. | 2.0 |
| 2600° F. | 2.0 |
| 2700° F. | 2.0 |
| 3000° F. | No perceptable further shrinkage |

-continued

| | |
|---|---|
| Compressive Strength: (10% Deformation) | 1240#/Sq.Ft. |
| Approximate "K" Value At Mean Temperature Of: | |
| 500° F. | — |
| 1000° F. | .55 |
| 1500° F. | .81 |
| 2000° F. | 1.26 |

Referring once again to FIG. 2, the side walls 25 and 27 of the lining 17 includes fire walls 63 and 65 respectively which, in the illustrated embodiment, are made of ceramic fiber board having characteristics described above. These fire walls are in turn bonded by high temperature mortar to backing walls 67 and 69 respectively for added strength. The spaces between the backing walls 67 and 69 and the outer shell wall plates 51 and 55 respectively are packed with loose ceramic fiber fill 71 to complete the side walls 25 and 27.

As best seen in FIG. 4, a high temperature front fire wall 73 and a high temperature rear fire wall 75 complete the four-walled enclosure of the chamber 15. In the illustrated embodiment, these front and rear fire walls also are high temperature ceramic fiber board. Between these front and rear fire walls and the front and rear wall plates 53 and 57 respectively of the housing 13 are packed multiple layers of ceramic fiber blankets 77 to form a tight fit for the lining in the housing while allowing for expansion and contraction without excessive mechanical strain. In this connection, it will be noted that the fire chamber walls are held together without metallic or other kinds of rods or connectors. An interlocking relation between the four walls is provided by shallow channels 79, 81 and 83, 85, respectively, formed in the inner faces of the front and rear fire walls 73 and 75 which are used to interlock with the side fire walls 63 and 65 which slide in the channels in engaging relation with the front and rear fire walls. During expansion and contraction, this interlocking relation continues and provides integrity to the fire wall of the lining. Alternatively, a unitized box of four fire walls can be moulded or otherwise formed and set in place during assembly of the furnace. In this connection, attention is drawn to FIG. 3, wherein the lapped relationship is seen between the top blankets 77 and the blankets of the front and rear walls of the lining 17.

Returning once again to FIG. 2, it will be noted that the ceiling 29 extends from side to side in the form of an undulation. Thus, in the illustrated embodiment, the ceiling 29 that defines the top of the chamber 15 protrudes inwardly of the chamber from either side wall 25 and 27 to a lower line portion or line 87 that extends front to rear, is substantially parallel to and in between the heating elements 23 and is substantially centered above the volume 35 defined by the lines projecting the slot 21 to the rear fire wall 75. Such centering of the inmost portion of the ceiling over the center of the volume 35 affords concentration of heat uniformly to the hearth 19 and is desirable even if, for some reason, the slot and hearth are not centered with respect to the furnace proper. The line 87, which represents the most inwardly extent of the ceiling 29 into the chamber 15, is spaced above the volume 35. Such a ceiling form is in sharp contrast to the typical form of sprung arches made of fire brick that shape the ceiling of known batch-type furnaces. The form of the ceiling 29 set forth in this invention is advantageous over such arch-type ceiling because it decreases the volume of the chamber 15, and hence the amount of air to be heated; it allows space for the heating elements 23 to be located at the sides of the chamber, as is discussed in detail hereinafter; and it concentrates the heating effect of the elements on the hearth 19. It is believed that the precise protruding form that the ceiling 29 takes is not as important as the fact that at least a portion of it protrudes inwardly toward the center of the hearth, although spaced above it. Thus, in addition to the broadened sine-wave type curve undulated form illustrated, the form may be more of a broad based triangle projecting inwardly so that either its apex forms a single line 87 or a truncated apex forms two spaced apart lines (not shown) to which the ceiling protrudes. A variation of this last suggested form is illustrated in an alternative interior structure in FIGS. 7–10 and discussed hereinafter.

In the FIG. 2 illustrated embodiment, the shape of the ceiling 29 is defined by a specially formed curved board 89 of ceramic fiber insulation. Above the board 89, all recesses are filled with the loose ceramic fiber fill 71 to form a level, and above that a plurality of ceramic fiber blankets 77 are packed between the top plate 59 of the housing and the ceramic fiber fill 71 to provide a tight fit.

The structure supporting the hearth 19 is also best illustrated in FIG. 2. Forms or molds are utilized to construct two "L" shaped (in cross section) hearth supports 91 and 93 that are poured of a castable insulating aggregate, much like concrete is poured in a form. Such an insulating aggregate is both insulative and supportive. The supports 91 and 93 are spaced apart back to back to support the side edges of the hearth 19. The space between the supports 91 and 93 is filled in with loose ceramic fiber fill 71, and the whole combination is overlayed by a platform 95, preferably also poured of the castable insulating aggregate as used for the supports 91 and 93. Although the platform 95 is both supportive and insulative, preferably a heavy duty fireclay brick is laid over the platform 95 to form the hearth 19. Such fireclay brick is capable of withstanding physical abuse the hearth receives from the forging steel.

As a safety precaution for personnel, a plurality of guard bricks 97 are provided to partially enclose the working area for the forging stock as represented by the volume 35. As best seen in FIG. 2, these guard bricks include a vertically extending body 99 and an overhead projection member 101, these members 101 being directed inwardly toward the center of the hearth 19, but extending only part of the way. A purpose of these guard bricks and their particular structure is to limit the rods 37 generally to the volume 35 as defined by the inwardly extending projection lines of the slot 21. Such restriction serves to inhibit direct contact of the steel rods 37 with the heating elements 23. As a further precautionary measure, however, the entire surface of the portal or input side of the slot 21 is covered with a conductive metal frame 103 tied to the grounded housing 13 to insure grounding of any rod 37 that might accidentally touch a heating element 23. By means of a ground detection unit provided in the circuitry, as discussed hereinafter in connection with FIG. 5, if such a ground fault occurs the power to the furnace is instantly shut off.

Preferably, the guard bricks 97 are made of a highly heat conductive material such as silicon carbide, or they may have a high percentage of alumina ($AL_2O_3$) in their content to make them highly conductive to heat. The guard bricks 97 are incorporated on each side of the hearth floor primarily to act as a block to the steel bars and prevent them from hitting the heating elements 23. Because they are in the line of sight radiation from the lower heating elements they are preferably made of a hard-highly conductive brick to permit fast flow of heat through them. A suitable instrument, such as a diamond saw, may be used to cut the desired shape of the guard bricks from rectangular material. It will be noted that when the guard bricks are in position, their location and shape is such as to encompass the volume 35, which means the inner edges of opposing guard bricks are separated by a distance substantially coextensive with the height of the slot 21.

The guard bricks 97 are set into position on the feet of the supports 91 and 93 and their positions secured by a row each of insulating fire bricks 105 and 107 outwardly adjacent the supports 91 and 93 respectively. Filler walls 109 and 111, preferably poured of a castable insulating aggregate, are provided between the rows of insulating bricks 105 and 107 and the side fire walls 63 and 65 respectively. A plurality of suitable anchor members 113 may be provided in the areas where the castable aggregate is poured to anchor the furnace through its base plate 61 to the support table 39.

The slot 21 preferably is made as small as possible consistent with the need to accommodate the forging stock. The smaller the opening, the less heat loss through this opening. Such a small slot also minimizes the possibility of an operator directly contacting the laterally mounted electrical elements with the forging stock. Heat loss through the slot 21, however, cannot be completely eliminated, and as best seen in FIG. 1, provision is made on the front of the furnace 11 for dissipating the heat that does escape from the slot and to maintain a working temperature on the front of the outside shell of the furnace that is safe for operating personnel.

For this purpose, a front cover 115 is provided that has perforated side body portions 117 and 119, a sloping solid deflector 121, a front panel 123 vertically extending upwardly from the front edge of the deflector 121, and a top panel 125 extending across the entire cover. The perforated side body portions 117 and 119 have perforated bottoms also. The perforated body portions 117 and 119 also serve the purpose of enclosing the protruding front ends of the heating elements 23 (FIG. 3) wherein the needed electrical connections are made. Preferably, the deflector panel 121 is made of stainless steel or a suitable alloy thereof.

Returning once again to FIG. 2, at least one electrical element 23 is provided inwardly adjacent each of the lining side walls 25 and 27 but outwardly adjacent the volume 35, which represents the work area for heating the forging stock. In the illustrated embodiment, three such heating elements 23 are provided at each side location. It is, of course, well known to pass electric current through resistance elements to transform electrical energy into heat energy, and one form of such resistance element in which the efficiency of this energy transfer is high is a rod or bar made up of silicon carbide crystals. Such silicon carbide elements are capable of operating at the temperatures needed for forging steel while yet having the desirable characteristics of providing stable and precise heating over a relatively long useful life. Furthermore, such elements are substantially non-corrosive under such elevated temperature conditions. The silicon carbide rods 23 in the illustrated embodiment extend through the refractory lining 21 to the outside of the furnace where the electrical connections (not shown) to the power circuit 33 (FIG. 5) are made. Adequate clearance holes are made for the elements in the front and back housing plates 53 and 57, respectively, and close fitting holes are made through the refractory lining 17. Loose ceramic fiber fill, such as that used at 71, is utilized to pack the elements into the lining walls, and this allows easy removal of an element when the element must be replaced. After replacement, the element should be repacked in the openings through the linings with the loose ceramic fiber fill.

It is noted that the heating elements 23 in the illustrated embodiment are stacked three outwardly of one side and three outwardly of the other side of the hearth 19 and the volume 35. Secondly, it is noted that the shape of the members below the electrical elements 23, i.e., the guard bricks 97, the rows of insulating fire brick 105 and 107, and the filler walls 109 and 111 form a trough along each side of the hearth 19 and directly below the heating elements 23. Thus, in the unlikely event that a heating element is broken, it or portions of it, will fall into the trough below at the side of the hearth rather than on the hearth itself. Furthermore, the disposition of the heating elements 23 on either side of the hearth also serves to inhibit direct contact of the forging steel with the elements.

Referring now to FIG. 5, electrical power is applied to the heating elements 23 by means of the power circuit 33. A suitable power source 127 provides the power, and generally, the kinds of power required for such heating will be supplied from a three-phase 60 Hz source of a suitable voltage, such as 480 v. The source is connected directly to the input side of a suitable three-phase circuit breaker 129 having an integral shunt trip 131. Thus, the circuit breaker will trip not only from a current overload through its main contacts, but also at any time the shunt trip circuit 131 is energized, which in this instance is when a ground fault is detected on any phase of the circuitry as described hereinafter.

The output of the circuit breaker 129 is connected to a solid state controller 133 which in turn controls the voltage applied to the primary of a three-phase isolation type transformer 135. The heater elements or furnace resistors 23 are equally divided for connection to each phase of the three-phase circuit. In the illustrated embodiment, there are six resistors, two per phase connected in series with the phases connected in a wye. As indicated previously, the furnace outer shell housing 13 is made of metal and is grounded. There is also provided in the circuit 33, a conventional three-phase resistor type ground detection circuit 137, which includes a relay to energize the solenoid of the shunt trip 131 should a ground fault occur on any of the three phases. If a ground fault occurs and the shunt trip is activated, the circuit breaker 129 immediately opens and removes power from the furnace resistors 23. An example of such a circuit is generally given in *IEEE Transactions on Industry Applications,* Vol. 1A-8, No. 3, May/June, 1972, pp. 231–236.

One segment of the circuit 33 is a temperature control circuit 139 which includes the temperature sensor 31 (FIGS. 3 and 4). This temperature sensor 31 is disposed adjacent the hearth 19, and preferably, it is embedded in the fireclay bricks that make up the hearth 19. As is seen in FIGS. 3 and 4, the sensor extends to the approximate center point of the hearth 19. This thermal sensor 31 preferably includes a thermocouple located inside the tip of its tubular structure. A small continuous current signal is generated between the thermocouple and a reference voltage that is inversely related to the temperature of the hearth. This current signal is coupled into the solid state controller 133, which operates in response to the signal. In the preferred embodiment, an SCR phase shift controller utilizing conventional circuitry and known technology is used to accurately control in smooth infinite steps the power applied to the furnace resistors 23 to maintain a desired furnace temperature for forging steel within ±10° F. The SCR circuit is capable of completely shutting off power, applying full power, or applying modulated power through the transformer 135 to the resistors 23 in response to the signal from the sensitive thermocouple (not shown) in the tip of the sensor 31.

Because the silicon carbide rods used as the heating elements 23 age, i.e., experience a persistent increase in resistance with use, it is desirable to provide taps on the output of the voltage transformer 135 for adjusting the full secondary voltage that can be applied to the resistors 23. For example, taps may be provided on each phase at 25 volt increments for a range in line to line RMS output voltage of from about 100 to 240 volts (six taps per phase).

As a result of the structure described in accordance with this invention, the heat insulating lining 17 and the hearth 19 along with its foundation provides the characteristics of very low heat loss and low heat absorption. This allows rapid and efficient heat transfer from the resistors 23 to the steel to be forged. Further, the disposition of the sensor 31 which locates the thermocouple in the center of the hearth 19 causes an immediate response to the cold steel entering the furnace and measures the temperature continuously to bring about a power application to the resistors through the solid state control as needed to hold the temperature within the tolerance required.

Figure 6:
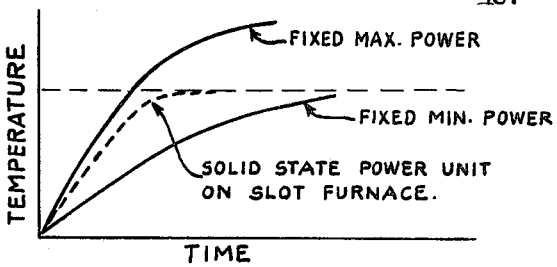
FIG. 6 is a graph illustrating the effect of the power and control circuit of FIG. 5 in the operation of the furnace of FIG. 1.

Further in accordance with this invention, FIG. 6 illustrates the rapid increase in temperature of the furnace to the desired working temperature that the illustrated power and control circuit 33 brings about in the furnace 11 without an overshoot of power. Thus, the desired temperature is reached efficiently, rapidly, and with only the minimum of power sufficient to maintain the desired temperature thereafter.

Because all of the heat is generated entirely within the chamber 15, a minimum of air circulation exists. Scaling of the steel thus is minimized, and this allows a finer surface on the finished product, a greater forging die life, and the use of smaller sizes of steel rods or bars for the product to be forged. The combination of the high temperature heating elements 23, the extremely low heat loss through heat absorption of the lining 17, the solid state power supply which causes the furnace temperature to increase very rapidly while being precise enough to modulate the power to not overshoot the temperature, and the small volume that must be heated of the chamber 15 provides an electrically powered slot furnace in accordance with the invention that is able to compete economically with present day furnaces that are either gas or oil-fired.

One example of a furnace that has been constructed in accordance with this invention includes a furnace 11 (FIG. 1) having external dimensions of 48 inches wide×35 inches deep×34 inches high. The furnace is suitably anchored to a support table 39 that mounts the base of the furnace 11 approximately 40 inches above the floor 45. The pads 43 are 6 inch square, one-quarter inch thick steel plates and the springs 41 are four inches OD and three and one-half inches ID. Anchor bolts 47 are provided.

The slot 21 is two inches high×twenty two inches wide×seven inches deep.

With reference to FIG. 2, the blankets 77 are each one inch thick, and the fire walls 63, 65 and the ceiling board 89 are each about two inches thick. The distance from the line 87 to the top of the hearth 19 is approximately 11 inches, and the distance between the side walls 25 and 27 through the chamber 15 is approximately 34 inches. The depth of the working area of the hearth, i.e., the distance between the front and rear fire walls 73 and 75 respectively (FIG. 4) is approximately 18 inches. There are six heating elements 23, and each are silicon carbide rods having a diameter of 2⅛" and a length of 37 inches. The rods used are known as GLO-BAR type LL as manufactured by Carborundum Company, Niagara Falls, N.Y. In this example, the top two resistors (FIG. 2) are connected in one phase, the two lower resistors on the left in the figure are connected in a second phase, and the two lower resistors on the right are connected in the third phase of the circuit.

The desired forging temperature for the steel is approximately 2250° F., and for this a 50 kva power supply, i.e., FIG. 5 circuit elements 129–135, from a power source of 480 volt, three-phase 60 Hz is utilized to supply energy to the furnace. The controller 133 is an SCR phase-shifting type manufactured by Magnetics, Inc. of Sandy Lake, Pa.

This example furnace provides 300 pounds of forging steel per hour at an electrical usage of approximately 43 KWHR.

To prolong resistor life, it has been found desirable to maintain a temperature of 1500° F. during all non-production hours. During this time, the slot 21 is plugged to absolutely minimize losses and amount of power needed to maintain the resistors at 1500° F. On production days, 10–15 min. is required to elevate the fire chamber of the furnace from 1500° F. to 2250° F. and to allow the fire chamber to stabilize.

An alternative interior structure of the furnace just described is shown in FIGS. 7–10 where reference numbers with subscripts indicate like parts. Thus, a furnace **11*a* is shown which differs from the furnace 11 principally in the structure of the top of the chamber 15*a* and the front and rear fire walls of the refractory lining 17*a*. For ease of illustration, only the rear fire wall 75*a* of these two walls is shown, but it should be understood that the front fire wall is similar in structure to the illustrated rear fire wall 75*a***.

Figure 7:
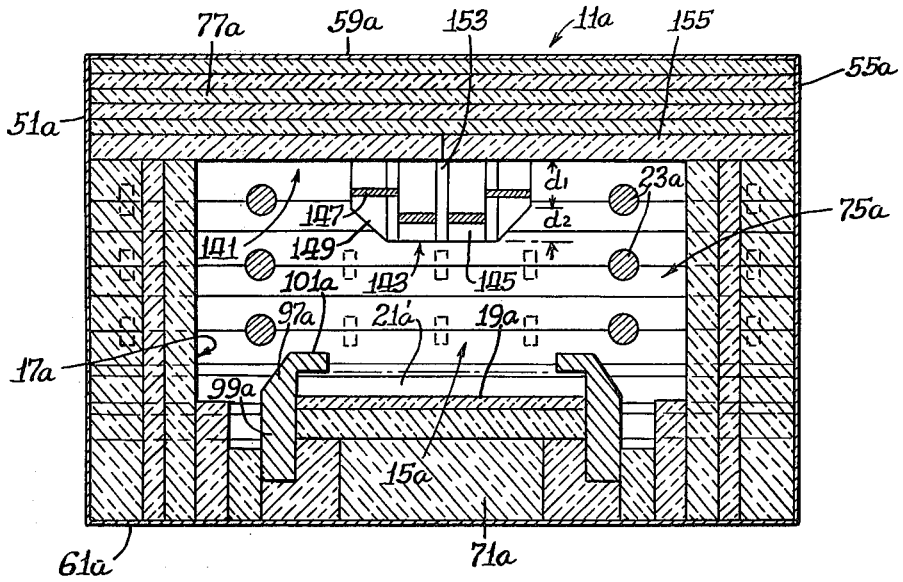
FIG. 7 is a sectional view similar to FIG. 2 illustrating an embodiment having an alternative interior structure.
Figure 8:
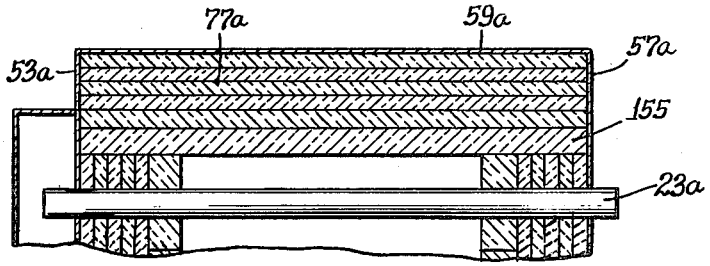
FIG. 8 is a partial side sectional view similar to FIG. 3 illustrating the alternative interior structure of the furnace of FIG. 7.
Figure 10:
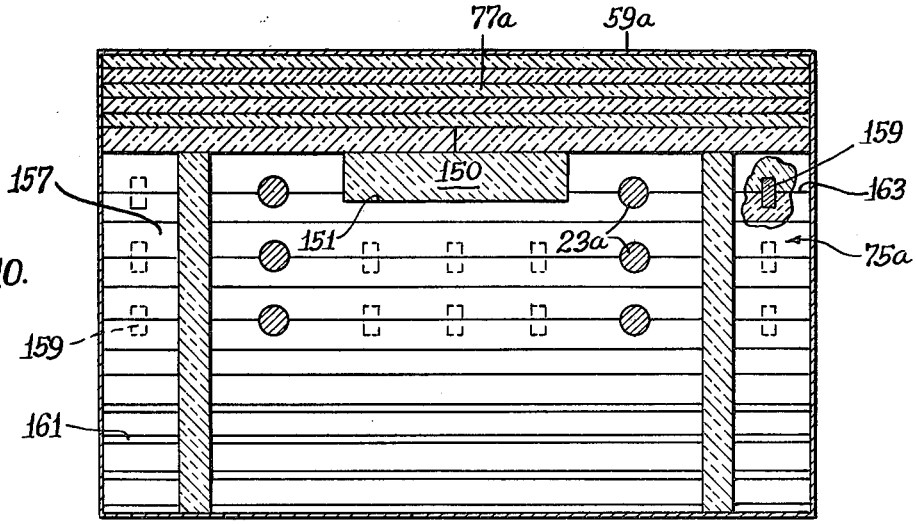
FIG. 10 is a sectional view taken along the line 10—10 of FIG. 9 to illustrate the rear fire wall in the alternative interior structure of the furnace of FIG. 7.

Referring now to FIG. 7, a ceiling 141 is shown that has a portion protruding inwardly between the heating elements **23*a*, the portion being in the form of a beam 143. This beam is generally rectangular in cross section and immediately underlies the ceiling 141 and extends from front to rear of the chamber 15*a*, i.e., from the front fire wall having the access slot (positionally the same as front fire wall 73 of the lining 17 through which is the slot 21 of FIGS. 1 and 4) to the opposite or rear fire wall 75*a*. The beam 143 includes a plurality of slabs 145 that preferably are stiff and flat and generally rectangular in cross section. These slabs are placed broad face to broad face and secured together by means of plugs 147 formed of a moldable ceramic fiber and cured after molding to a rivet-like structure. The slabs themselves are preferably of an alumina ceramic fiber composition as previously disclosed herein. Their widths are disposed vertically in the structure to provide supportive strength to the ceiling 141. In the illustrated embodiment, the beam has been made from alumina ceramic fiber boards that are approximately two inches thick and approximately six inches wide. The lower side edges of the beam 143 are beveled at 149 by an angle of approximately 45°. The lower surface of the beam is disposed above the projection 21'a of the slot in a manner similar to the lowest extent 87 of the ceiling 29 in the furnace 11 (FIG. 2). In this connection, the ratio of $d_1$ to $d_2$ in FIG. 7 may be 2:1. The configuration as shown in cross section for the beam extends between the fire walls, but each end of the beam is formed into a rectangular shaped stud 150 (FIG. 10) so as to interlock with a respective adjacent fire wall in a conforming slot, such as a slot 151 in the rear fire wall 75a as illustrated in FIG. 10**.

The width of the beam 143 is determined by the number of slabs 145 comprising the lamination, but the width can be further adjusted by interleaving blankets 153 intermediate the faces of the rectangular slabs. The material of the blankets also is preferably of an alumina ceramic fiber composition in the soft blanket form as previously described. In such instance, the plugs 147 secure both the blankets and the slabs. The illustrated beam 143 is approximately nine and one-half inches wide and six inches high, i.e., $d_1$ plus $d_2$ equals six inches.

The ceiling 141 in this embodiment comprises a pair of two inches thick boards 155 that meet in the center of the furnace 11a over the beam 143. Thereover, five one-inch blanks 77a are applied to complete the top of the lining 17a. As seen in both FIGS. 7 and 8, the ceiling boards 155 and blankets 77a on the top extend across the full length and width of the furnace within the housing plates 51a, 53a, 55a and 57a, and thus across the top of the front, side and rear fire walls.

Figure 9:
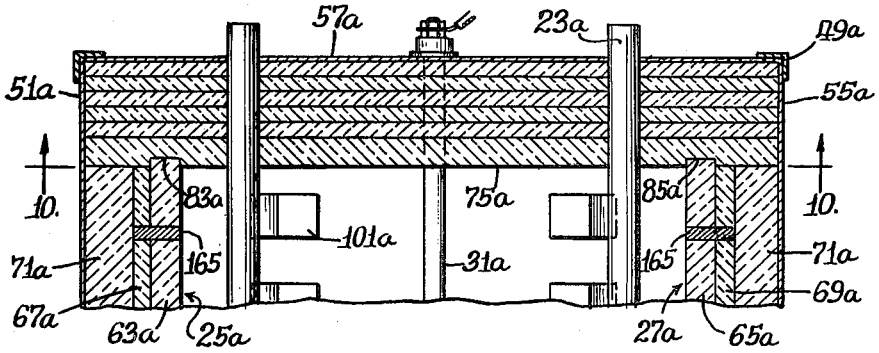
FIG. 9 is a partial plan sectional view similar to FIG. 4 illustrating the alternative interior structure of the furnace of FIG. 7.

The front and rear walls of the refractory lining 17a each comprise layers of horizontally oriented material vis-a-vis vertically extending blankets and boards of the furnace 11 (FIG. 3). The rear fire wall 75a is best seen in FIGS. 9 and 10. In particular, a stack of horizontal slabs or ribs 157 are illustrated in FIG. 10. These ribs may be, for example, two inches high by four inches deep, and preferably are also of an alumina ceramic fiber composition. Some adjacent ribs in the stack are interconnected by plugs 159, which, like the plugs 147 in the beam 143, are formed of a moldable ceramic fiber and have been cured after molding, resulting in a rivet-like structure. Such interconnection is desirable in the interface, for example, of adjacent members through which the heating elements 23a extend as illustrated (FIGS. 7 and 10). The ribs 157 preferably are stiff and flat, but they may also be interleaved with varying thicknesses of blankets 161 of an alumina ceramic fiber composition in the soft, flexible form to cause the stack of ribs 157 to reach the desired height as needed to form the rear fire wall 75a. To enhance the connection between the adjacent "locked" ribs where the plugs 159 are utilized, a suitable high temperature ceramic seal material 163 may also be provided. As mentioned previously, the front fire wall of the furnace 11a is constructed in a similar manner to that just described for the rear fire wall 75a.

While such stack of horizontally disposed ribs comprises the rear fire wall 75a, combinations of vertically disposed boards and blankets may be used to fill the space between this stacked rib construction and the rear plate 57a of the housing to complete this portion of the lining 17a, and the front portion of the lining 17a (not shown) may be constructed similarly.

In FIG. 9 it will be seen that the side walls 25a and 27a are constructed in the furnace 11a similar to the walls 25 and 27 in furnace 11 (FIGS. 2 and 4). Shallow channels 83a and 85a in the rear fire wall 75a and similar channels opposing in the front fire wall (not shown) are provided to interlock with the side fire walls 63a and 65a. To provide increased strength in these side fire walls, a plurality of plugs 165 formed of a moldable ceramic fiber and cured after molding are used to interconnect the side fire walls 63a and 65a with the backing walls 67a and 69a respectively. Loose ceramic fiber fill can be used to fill the space between the backing plates and the housing wall plates 51a and 55a respectively.

There has been supplied in accordance with this invention a slot furnace for heating steel to forging temperatures, such as temperatures approximating 2300° F., that operates economically from electrical energy without costly air purification equipment. Although operating costs are comparable at this time, there appears to be an economic advantage in utilizing electrical power in the future because of the scarcity of gas and oil and the availability, on the other hand, of nuclear power for electricity.

The furnace of this invention utilizes high temperature, high power silicon carbide resistance elements as heating elements. The furnace also utilizes a high temperature ceramic fiber insulation made of high-alumina ceramic fiber and inorganic bonds as the refractory material to insulate the firing chamber of the furnace. This insulation is in the form of boards, soft blankets, and loose fiber and provides low heat loss and low heat absorption that is necessary for rapid and efficient heat transfer from silicon carbide resistors to the steel to be forged. The furnace of this invention further utilizes solid state electronic control systems to accurately control the power flow to the furnace resistors for maintaining an extremely close furnace working or firing temperature. Power is turned on or shut off or modulated in response to a very small electric current signal provided by a thermocouple and sensing circuit. The thermocouple is embedded in the center of the hearth to rapidly sense the temperature of the steel to be forged that is placed on the hearth.

In the furnace structure of the invention, the resistors are located on either side of the hearth, the sides of the hearth incorporate guard bricks, the slot is small and its portal is line with metal connected to a ground, and the circuitry includes a ground detection relay circuit to shut off power if a ground fault develops, all to maximize safety to operating personnel.

The ceiling of the fire chamber protrudes inwardly of the chamber to a region spaced above the hearth. Such structure both reduces the volume within the chamber and serves to concentrate the heat from the electrical elements to the working area of the hearth where the forging steel is heated. The fire walls and ceiling of the chamber are interlocked without metallic rods or other connectors, and the insulation lining is packed tightly within the metal shell housing of the furnace while allowing the needed expansion and contraction without excessive mechanical strain. The small slot minimizes heat loss and the amount of air circulation within the chamber. The reduced air circulation within the chamber reduces scaling on the steel, and a heat dissipating cover is provided on the front of the furnace to dissipate the heat without increasing the temperatures of the housing to that which is dangerous for operating personnel. The furnace of this invention rapidly comes up to the desired operating temperature without overshoot and maintains temperature accurately and with an efficient use of power.

It is intended that the term "hearth" as used herein include the entire lower or bottom inner structure of the furnace 11 generally between the guard bricks 97 as well as the floor surface of the furnace chamber 15, particularly that portion below the volume 35 (FIG. 2).

While the invention has been described in connection with a preferred embodiment with an alternative interior, other alternatives, modifications and variations may be apparent to those skilled in the art in view of the foregoing description. Accordingly, it is intended to embrace all such alternatives, modifications and variations as fall within the spirit and scope of the appended claims.

What is claimed is:

1. A slot furnace for heating steel to forging temperatures, comprising: a housing; a chamber in said housing for receiving forging stock; a refractory lining in said housing the inner surface of which generally defines said chamber; a refractory hearth; a slot at the front of the housing adjacent said hearth and having communication through said lining to said chamber through which forging stock is inserted and withdrawn; an electrical heating element at each side of said chamber inwardly adjacent the respective side walls of said lining and outwardly adjacent the sides of said hearth and extending in a direction generally perpendicular to the plane of said slot; a refractory ceiling defining the top of said chamber protruding inwardly thereof from either side wall to a line paralleling said electrical heating elements and disposed therebetween and spaced above said slot; means for connecting said heating elements to an electrical power source; a temperature sensor disposed adjacent said hearth; and means connected to said sensor between said elements and said power source for controlling the electrical power applied to said elements in response to said sensor.

2. A furnace in accordance with claim 1 wherein said housing is metal and is grounded and wherein all surfaces of the input side of said slot are covered with metal frame which also is grounded.

3. A furnace in accordance with claim 1 wherein each of said heating elements is located between the inner surface of a side wall of said lining and a vertical plane containing the nearest side edge of said hearth, whereby said heating elements are disposed outwardly laterally of each side edge of the hearth.

4. A furnace in accordance with claim 3 further including a plurality of upstanding guard members on each side of said hearth, each of said guard members having an upper projecting portion extending part way to and in the direction of the center of said hearth, the distance separating the inner edges of opposing guard members being substantially coextensive with the width of said slot and the distance between the hearth and the underside of the upper projecting portion being substantially coextensive with the height of said slot.

5. A furnace in accordance with claim 1 wherein said ceiling defining the top of said chamber is contoured from side to side in the undulated form of a symmetrical portion of a sine wave that includes the lowermost portion of the wave as its center, this lowermost portion being positioned in said chamber above said slot and midway between the side edges of said slot.

6. A furnace in accordance with claim 1 wherein said temperature sensor is disposed in said hearth at substantially the center thereof.

7. A furnace in accordance with claim 1 wherein said means for controlling the electrical power applied to said elements includes a solid state electronic control system.

8. A furnace in accordance with claim 7 wherein said sensor is a thermocouple that generates an electrical signal in response to the temperature of said hearth and wherein said solid state electronic control system includes an SCR phase shifting circuit that functions in response to the signal from said thermocouple.

9. A furnace in accordance with claim 1 further including a ground detection relay circuit to shut off power upon development of a ground fault in said furnace.

10. A furnace in accordance with claim 1 wherein said refractory lining includes high-alumina ceramic fiber in the form of boards, blankets, and loose fill and wherein the inner surface of said lining is capable of withstanding temperatures up to at least 3000° F.

11. A furnace in accordance with claim 1 wherein said heating elements are silicon carbide rods.

12. A furnace in accordance with claim 4 wherein said upstanding guard members are made of a hard, highly conductive material.

13. A furnace in accordance with claim 12 wherein the guard members comprise alumina.

14. A furnace in accordance with claim 12 wherein the guard members comprise silicon carbide.

15. A slot furnace for heating steel to forging temperatures, comprising:

a housing; a chamber in said housing for receiving forging stock, a refractory lining in said housing the inner surface of which generally defines said chamber; a refractory hearth; a slot at the front of the housing adjacent said hearth and having communication through said lining to said chamber through which forging stock is inserted and withdrawn; an electrical heating element at each side of said chamber inwardly adjacent the respective side walls of said lining; a refractory ceiling defining the top of said chamber and protruding inwardly thereof between said electrical heating elements and above said slot; means for connecting said heating elements to an electrical power source; a temperature sensor disposed adjacent said hearth; and means connected to said sensor for controlling the electrical power applied to said elements in response to said sensor.

16. A furnace in accordance with claim 15 wherein said electrical heating elements are generally parallel to the direction of stock insertion through said slot.

17. A furnace in accordance with claim 16 wherein said ceiling protrudes inwardly to a line paralleling said electrical heating elements and above said slot.

18. A furnace in accordance with claim 17 further comprising guard members intermediate said hearth and said heating units.

19. A furnace in accordance with claim 15 wherein each of said heating elements is disposed outwardly adjacent the sides of said hearth.

20. A furnace in accordance with claim 15 wherein said refractory lining comprises an alumina ceramic fiber composition the inner surface of which is capable of withstanding temperatures up to at least 3000° F.

21. A furnace in accordance with claim 15 further comprising means grounding at least the input side of said slot.

22. A slot furnace for heating steel to forging temperatures, comprising: a housing; a chamber in said housing for receiving forging stock, a refractory lining in said housing the inner surface of which generally defines said chamber; a refractory hearth; a slot at the front of the housing adjacent said hearth and having communication through said lining to said chamber through which forging stock is inserted and withdrawn; an electrical heating element at each side of said chamber inwardly adjacent the respective side walls of said lining; a refractory ceiling defining the top of said chamber having a portion protruding inwardly thereof between said electrical heating elements and above said slot, said portion having a generally rectangular cross section; means for connecting said heating elements to an electrical power source; a temperature sensor disposed adjacent said hearth; and means connected to said sensor for controlling the electrical power applied to said elements in response to said sensor.

23. A furnace in accordance with claim 22 wherein said heating elements extend in a direction generally parallel to the direction of stock insertion, and said protruding portion comprises a beam of generally rectangular cross section immediately underlying said ceiling and extending above said slot from the refractory lining of the wall that includes said slot to the refractory lining of the opposite wall.

24. A furnace in accordance with claim 23 wherein the beam comprises a plurality of slabs of alumina ceramic fiber composition, the slab width being disposed vertically and with adjacent slabs being interconnected by plugs formed of moldable ceramic fiber that have been cured after molding, and wherein the side edges of the lower horizontal surface of the beam are beveled.

25. A furnace in accordance with claim 24 wherein the slabs are rectangular in cross section and are stiff and flat.

26. A furnace in accordance with claim 25 further comprising alumina ceramic fiber composition in the form of soft blankets interleaving the rectangular slabs, said plugs securing the blankets and slabs.

27. A furnace in accordance with claim 22 in which the front and rear walls of refractory lining each comprise a stack of horizontal slabs of an alumina ceramic fiber composition with some adjacent slabs being interconnected by plugs formed of moldable ceramic fiber that have been cured after molding.

28. A furnace in accordance with claim 27 wherein the slabs are rectangular in cross section and are stiff and flat, and wherein at least some of the slabs are interleaved with an alumina ceramic fiber composition in the form of soft blankets.

29. A furnace in accordance with claim 22 wherein said electrical heating elements are disposed outwardly adjacent the sides of said hearth.

30. A furnace in accordance with claim 29 further comprising a guard member disposed on each side of said hearth extending generally upwardly intermediate said hearth and said electrical heating elements.

31. A furnace in accordance with claim 30 wherein each of said guard members has an upper projecting portion extending part way to and in the direction of the center of said hearth, the distance separating the inner edges of opposing guard members being substantially coextensive with the width of said slot and the distance between the hearth and the underside of the upper projecting portion being substantially coextensive with the height of said slot.

32. A furnace in accordance with claim 30 wherein said guard members are made of a hard, highly conductive material.

33. A furnace in accordance with claim 32 wherein the guard members comprise alumina.

34. A furnace in accordance with claim 32 wherein the guard members comprise silicon carbide.

35. A furnace in accordance with claim 22 wherein said temperature sensor is disposed in said hearth at substantially the center thereof.

36. A furnace in accordance with claim 22 wherein said means for controlling the electrical power applied to said heating elements includes a solid state electronic control system.

37. A furnace in accordance with claim 36 wherein said sensor is a thermocouple that generates an electrical signal in response to the temperature of said hearth and wherein said solid state electronic control system includes an SCR phase shifting circuit that functions in response to the signal from said thermocouple.

38. A furnace in accordance with claim 22 further comprising a ground detection relay circuit to shut off power upon development of a ground fault in said furnace.

39. A furnace in accordance with claim 22 wherein said heating elements are silicon carbide rods.

* * * * *